US008567895B2

(12) United States Patent
Furukawa et al.

(10) Patent No.: US 8,567,895 B2
(45) Date of Patent: Oct. 29, 2013

(54) ABNORMALITY JUDGMENT APPARATUS AND ABNORMALITY JUDGMENT METHOD OF LIQUID SUPPLY SYSTEM

(75) Inventors: Koji Furukawa, Kanagawa-ken (JP); Jun Isozaki, Ebina (JP); Masaki Kataoka, Ebina (JP)

(73) Assignees: FUJIFILM Corporation, Tokyo (JP); Fuji Xerox Co., Ltd., Tokyo (JP)

( * ) Notice: Subject to any disclaimer, the term of this patent is extended or adjusted under 35 U.S.C. 154(b) by 241 days.

(21) Appl. No.: 13/025,806

(22) Filed: Feb. 11, 2011

(65) Prior Publication Data

US 2011/0205265 A1 Aug. 25, 2011

(30) Foreign Application Priority Data

Feb. 23, 2010 (JP) ..... 2010-037627

(51) Int. Cl.
*B41J 29/393* (2006.01)
*B41J 2/175* (2006.01)

(52) U.S. Cl.
USPC ..... 347/19; 347/85

(58) Field of Classification Search
CPC ..... B41J 29/38; B41J 2/17556; B41J 2/17566
USPC ..... 347/6, 7, 19, 84, 85
See application file for complete search history.

(56) References Cited

U.S. PATENT DOCUMENTS 5,772,832 A 6/1998 Collins et al.
7,357,478 B2 * 4/2008 Usuda et al. ..... 347/29
7,373,931 B2 5/2008 Lennox et al.
8,109,613 B2 * 2/2012 Nitta et al. ..... 347/59
8,235,482 B2 * 8/2012 Katada ..... 347/6
2006/0109321 A1 5/2006 Nottelman et al.
2007/0070132 A1 3/2007 Sze et al.
2009/0102879 A1 4/2009 Katada et al.
2009/0244226 A1 10/2009 Hoshino
2010/0188454 A1 7/2010 Murakami et al.
2010/0245494 A1 9/2010 Inoue et al.
2010/0327025 A1 12/2010 Yokoyama et al.

FOREIGN PATENT DOCUMENTS

EP 1491344 A2 12/2004
JP 7-205440 A 8/1995
JP 2000-229422 A 8/2000
JP 2004-286142 A 10/2004

(Continued)

OTHER PUBLICATIONS

Extended European Search Report for European Application No. 11155427.5 mailed Nov. 24, 2011.

(Continued)

*Primary Examiner* — An Do
(74) *Attorney, Agent, or Firm* — Birch, Stewart, Kolasch & Birch, LLP

(57) ABSTRACT

An abnormality judgment apparatus of a liquid supply system which supplies liquid from a liquid tank to a liquid ejection head via a liquid flow channel, includes: a pressure change application device which applies a pressure change to the liquid flow channel; first and second pressure measurement devices which measure a pressure in the liquid flow channel; and an abnormality judgment device which performs abnormality judgment and identification of an abnormal location in the liquid supply system, according to measurement values measured by the first and second pressure measurement devices before and after the pressure change is applied by the pressure change application device.

11 Claims, 11 Drawing Sheets

(56) References Cited

FOREIGN PATENT DOCUMENTS

| | | | |
|---|---|---|---|
| JP | 2006-150963 | A | 6/2006 |
| JP | 2006-231131 | A | 9/2006 |
| JP | 2009-67335 | A | 4/2009 |
| JP | 2009-101516 | A | 5/2009 |

OTHER PUBLICATIONS

Partial European Search Report dated May 12, 2011 for European Application No. 11155427.5.
Japanese Office Action issued from JPO on May 27, 2013 in Japanese patent Application No. 2010-037627.

* cited by examiner

FIG. 8

| | PT1 | PT2 | PT3 | PT4 | PT5 |
|---|---|---|---|---|---|
| P2>P1 | SATISFIED | UNSATISFIED | SATISFIED | SATISFIED | UNSATISFIED |
| Q2>Q1 | SATISFIED | SATISFIED | UNSATISFIED | SATISFIED | UNSATISFIED |
| P2≒P3 | SATISFIED | – | SATISFIED | UNSATISFIED | – |
| Q2≒Q3 | SATISFIED | SATISFIED | – | UNSATISFIED | – |
| ABNORMALITY JUDGMENT RESULT | NORMAL | SENSOR A DEFECTIVE | SENSOR B DEFECTIVE | INK LEAK | PUMP DEFECTIVE / FLOW CHANNEL BLOCKAGE |

FIG. 11

| | PT1 | PT2 | PT3 | PT4 | PT5 | PT6 | PT7 | PT8 | PT9 |
|---|---|---|---|---|---|---|---|---|---|
| R2>R1 | SATISFIED | UNSATISFIED | SATISFIED | SATISFIED | SATISFIED | SATISFIED | SATISFIED | UNSATISFIED | SATISFIED |
| S2>S1 | SATISFIED | SATISFIED | UNSATISFIED | UNSATISFIED | SATISFIED | SATISFIED | SATISFIED | UNSATISFIED | SATISFIED |
| R3>R2 | SATISFIED | UNSATISFIED | SATISFIED | UNSATISFIED | SATISFIED | SATISFIED | SATISFIED | SATISFIED | UNSATISFIED |
| S3>S2 | SATISFIED | SATISFIED | UNSATISFIED | SATISFIED | SATISFIED | SATISFIED | SATISFIED | SATISFIED | UNSATISFIED |
| R3≒R4 | SATISFIED | SATISFIED | SATISFIED | SATISFIED | SATISFIED | UNSATISFIED | UNSATISFIED | SATISFIED | SATISFIED |
| S3≒S4 | SATISFIED | SATISFIED | SATISFIED | SATISFIED | SATISFIED | UNSATISFIED | UNSATISFIED | SATISFIED | SATISFIED |
| R6>R5 | SATISFIED | UNSATISFIED | SATISFIED | SATISFIED | SATISFIED | SATISFIED | SATISFIED | UNSATISFIED | SATISFIED |
| S5≒S6 | SATISFIED | SATISFIED | SATISFIED | SATISFIED | UNSATISFIED | SATISFIED | SATISFIED | SATISFIED | SATISFIED |
| S7>S6 | SATISFIED | SATISFIED | UNSATISFIED | SATISFIED | SATISFIED | SATISFIED | SATISFIED | SATISFIED | UNSATISFIED |
| R6≒R7 | SATISFIED | SATISFIED | SATISFIED | SATISFIED | UNSATISFIED | SATISFIED | SATISFIED | SATISFIED | SATISFIED |
| R7≒R8 | SATISFIED | SATISFIED | SATISFIED | SATISFIED | SATISFIED | UNSATISFIED | SATISFIED | SATISFIED | SATISFIED |
| S7≒S8 | SATISFIED | SATISFIED | SATISFIED | SATISFIED | SATISFIED | SATISFIED | UNSATISFIED | SATISFIED | SATISFIED |
| ABNORMALITY JUDGMENT RESULT | NORMAL | SENSOR A DEFECT | SENSOR B DEFECT | BYPASS VALVE: OPEN FAULT | BYPASS VALVE: CLOSED FAULT | SUPPLY FLOW CHANNEL: INK LEAK | RECOVERY FLOW CHANNEL: INK LEAK | SUPPLY PUMP DEFECT / SUPPLY FLOW CHANNEL BLOCKAGE | RECOVERY PUMP DEFECT / RECOVERY FLOW CHANNEL BLOCKAGE |

ABNORMALITY JUDGMENT APPARATUS AND ABNORMALITY JUDGMENT METHOD OF LIQUID SUPPLY SYSTEM

BACKGROUND OF THE INVENTION

1. Field of the Invention

The present invention relates to an abnormality judgment apparatus and an abnormality judgment method of a liquid supply system, and more particularly to technology for judging abnormalities and identifying the location of abnormalities in a liquid supply system which supplies liquid from a liquid tank to a liquid ejection head via a liquid flow channel.

2. Description of the Related Art

An ink supply apparatus for supplying ink to a recording head (inkjet head) is generally provided in an inkjet recording apparatus. An ink supply apparatus mainly includes an ink tank which accommodates ink, an ink supply channel which connects the recording head with the ink tank, and a pump which is provided in the ink supply channel, and ink is supplied from the ink tank to the recording head via the ink supply channel in accordance with the driving of this pump.

If an abnormality occurs in the ink supply apparatus, not only does normal printing become impossible, but there is also the possibility of trouble such as leaking of the ink to the exterior of the apparatus.

In particular, in an inkjet recording apparatus having high productivity which is capable of printing printed items of large size at high speed, sufficient ink must be supplied at a high flow rate enough to be consumed by the recording head, and if there is trouble in the ink supply apparatus, then there is a possibility of a larger amount leaking outside the apparatus. Furthermore, in order to be able to restore conditions rapidly after the occurrence of an abnormality, it is necessary to be able rapidly to identify the location of an abnormality.

Therefore, in an inkjet recording apparatus, one major technical issue is to be able to rapidly detect abnormalities in respective devices of an ink supply apparatus, while ensuring stable printing, and thus preventing trouble such as ink leaks, in advance, as well as being able rapidly to identify the locations of abnormalities so as to be able to restore the apparatus swiftly in the event of an abnormality. Various technologies relating to ink supply have been proposed hitherto (see, for example, Japanese Patent Application Publication No. 7-205440, and Japanese Patent Application Publication No. 200-229422).

Japanese Patent Application Publication No. 7-205440 discloses technology which selectively activates a first halt control device which halts a supply of ink to a recording head and also supplies a solution and then halts operation, and a second halt control device which terminates ink supply to a recording head and immediately halts operation, to minimize soiling caused by leaking of ink, even if an abnormal state causing leaking of ink has occurred.

Japanese Patent Application Publication No. 2000-229422 describes technology whereby, if the number of revolutions of a motor lies outside a predetermined tolerable range when the ink pressure supplied to nozzles of a recording head matches a predetermined correct value, an abnormality is taken to have occurred in the components, such as a pump which conveys ink to the nozzles, a motor which drives the pump, a filter which is provided in the ink supply tube, or an ink supply channel which is disposed between the ink tank and the nozzle, and so on, and the inkjet recording apparatus is automatically halted.

However, in the technology described in Japanese Patent Application Publication No. 7-205440, there is no concrete description of the method of detecting abnormalities and it is not possible to identify the location of an abnormality.

The same applies to the technology described in Japanese Patent Application Publication No. 2000-229422, and it is not possible to judge whether the cause of an abnormality is due to a sensor, motor, flow channel leak or flow channel blockage.

In this way, in the related art technology, it is not possible to identify specifically the location of an abnormality occurring in the ink supply apparatus, and hence it is difficult to restore the ink supply apparatus rapidly after the occurrence of an abnormality.

SUMMARY OF THE INVENTION

The present invention has been contrived in view of these circumstances, an object thereof being to provide an abnormality judgment apparatus and abnormality judgment method of a liquid supply system whereby swift restoration is possible if an abnormality has occurred in a liquid supply system, and a stable liquid supply can be achieved.

In order to attain an object described above, one aspect of the present invention is directed to an abnormality judgment apparatus of a liquid supply system which supplies liquid from a liquid tank to a liquid ejection head via a liquid flow channel, the abnormality judgment apparatus comprising: a pressure change application device which applies a pressure change to the liquid flow channel; first and second pressure measurement devices which measure a pressure in the liquid flow channel; and an abnormality judgment device which performs abnormality judgment and identification of an abnormal location in the liquid supply system, according to measurement values measured by the first and second pressure measurement devices before and after the pressure change is applied by the pressure change application device.

According to this aspect of the invention, a pressure change is applied to a liquid flow channel by a pressure change application device, and the pressure in the liquid flow channel before and after the pressure change is measured by first and second pressure measurement devices. By comparing the direction in which the pressure change is applied by the pressure change application device with the direction of change of the measurement values obtained by the first and second pressure measurement devices, it is possible to judge the presence or absence of an abnormality in the liquid supply system, and also to identify the location of the abnormality. By this means, if an abnormality occurs in the liquid supply system, then it is possible to restore the system rapidly, and hence stable and highly reliable liquid supply can be achieved.

Desirably, if the measurement value obtained by one of the first and second pressure measurement devices changes in a direction which is same as a direction in which the pressure change is applied by the pressure change application device, and the measurement value obtained by the other of the first and second pressure measurement devices changes in a direction opposite to the direction in which the pressure change is applied by the pressure change application device or does not change, then the abnormality judgment device identifies the other of the first and second pressure measurement devices as the abnormal location.

Desirably, if the measurement values obtained by the first and second pressure measurement devices both change in a direction opposite to a direction in which the pressure change is applied by the pressure change application device or do not change, then the abnormality judgment device identifies the pressure change application device or the liquid flow channel as the abnormal location.

Desirably, if the measurement values obtained by the first and second pressure measurement devices both change beyond a prescribed range in a state where the pressure change is not applied by the pressure change application device, the abnormality judgment device identifies the liquid flow channel as the abnormal location.

Desirably, the pressure change application device is a liquid pump disposed in the liquid flow channel.

Desirably, the abnormality judgment device performs the abnormality judgment and the identification of an abnormal location before main operation of the liquid supply system is started.

In order to attain an object described above, another aspect of the present invention is directed to an abnormality judgment apparatus of a liquid supply system which supplies liquid from a liquid tank to a liquid ejection head via a first liquid flow channel and recovers liquid from the liquid ejection head to the liquid tank via a second liquid flow channel, the abnormality judgment apparatus comprising: a pressure change application device which applies a pressure change to each of the first and second liquid flow channels; a first pressure measurement device which measures a pressure in the first liquid flow channel; a second pressure measurement device which measures a pressure in the second liquid flow channel; and an abnormality judgment device which performs abnormality judgment and identification of an abnormal location in the liquid supply system, according to measurement values measured by the first and second pressure measurement devices before and after the pressure change is applied by the pressure change application device.

Desirably, the abnormality judgment apparatus of a liquid supply system further comprises: a bypass flow channel which directly connects the first liquid flow channel with the second liquid flow channel without passing through the liquid ejection head; and a flow channel opening and closing device configured so as to be capable of opening and closing the bypass flow channel, wherein the abnormality judgment device performs the abnormality judgment and the identification of an abnormal location in the liquid supply system, according to measurement values obtained by the first and second pressure measurement devices when the bypass flow channel is closed by the flow channel opening and closing device, and measurement values obtained by the first and second pressure measurement devices when the bypass flow channel is opened by the flow channel opening and closing device.

Desirably, the liquid ejection head is a line head constituted by a plurality of head modules; and the plurality of head modules are connected to the first and second liquid flow channels via first and second branch channels which are provided for each of the plurality of head modules.

In order to attain an object described above, another aspect of the present invention is directed to an abnormality judgment method of a liquid supply system including a pressure change application device which applies a pressure change to a liquid flow channel via which liquid is supplied from a liquid tank to a liquid ejection head; and first and second pressure measurement devices which measure a pressure in the liquid flow channel, the abnormality judgment method comprising the step of performing abnormality judgment and identification of an abnormal location in the liquid supply system according to measurement values measured by the first and second pressure measurement devices before and after the pressure change is applied by the pressure change application device.

According to the present invention, a pressure change is applied to a liquid flow channel by a pressure change application device, and the pressure in the liquid flow channel before and after the pressure change is measured by first and second pressure measurement devices. By comparing the direction in which the pressure change is applied by the pressure change application device with the direction of change of the measurement values obtained by the first and second pressure measurement devices, it is possible to judge the presence or absence of an abnormality in the liquid supply system, and also to identify the location of the abnormality. By this means, if an abnormality occurs in the liquid supply system, then it is possible to restore the system rapidly, and hence stable and highly reliable liquid supply can be achieved.

BRIEF DESCRIPTION OF THE DRAWINGS

A preferred embodiment of this invention as well as other objects and benefits thereof, will be explained in the following with reference to the accompanying drawings, in which like reference characters designate the same or similar parts throughout the figures and wherein:

FIG. 8 is a diagram showing an abnormal location identification judgment table which is used to identify the location of an abnormality in the flowchart in FIG. 7;

FIG. 11 is a diagram showing an abnormal location identification judgment table which is used to identify the location of an abnormality in the flowchart in FIG. 9.

DESCRIPTION OF THE PREFERRED EMBODIMENTS

First Embodiment

General Composition of Inkjet Recording Apparatus

Figure 1:
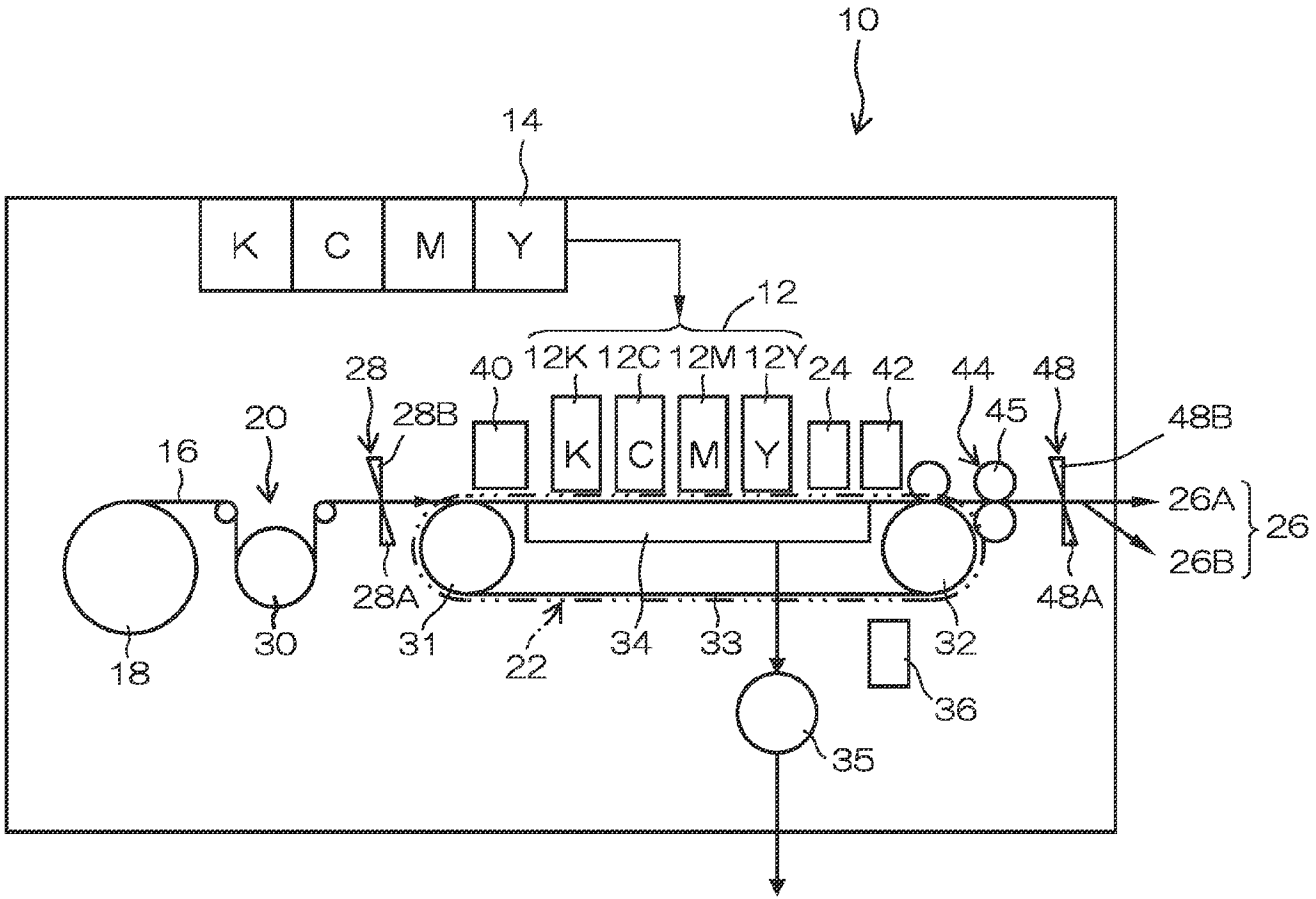
FIG. 1 is a general schematic drawing showing a general view of an inkjet recording apparatus.

FIG. 1 is a schematic general composition diagram of an inkjet recording apparatus serving as an example of an image forming apparatus according to an embodiment of the present invention. As shown in FIG. 1, the inkjet recording apparatus 10 comprises: a printing unit 12 having a plurality of recording heads (hereafter, simply called "heads") 12K, 12C, 12M, and 12Y provided for respective ink colors; an ink storing and loading unit 14 for storing inks of K, C, M and Y to be supplied to the print heads 12K, 12C, 12M, and 12Y; a paper supply unit 18 for supplying recording paper 16 which is a recording medium; a decurling unit 20 removing curl in the recording paper 16; a suction belt conveyance unit 22 disposed facing the nozzle face (ink-droplet ejection face) of the printing unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a magazine for rolled paper (continuous paper) is shown as an example of the paper supply unit 18; however, a plurality of magazines with paper differences such as paper width and quality may be jointly provided. Moreover, papers may be supplied with cassettes that contain cut papers loaded in layers and that are used jointly or in lieu of the magazine for rolled paper.

In the case of the configuration in which roll paper is used, a cutter 28 is provided as shown in FIG. 1, and the continuous paper is cut into a desired size by the cutter 28. The cutter 28 has a stationary blade 28A whose length is not less than the width of the conveyor pathway of the recording paper 16, and a round blade 28B which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

In the case of a configuration in which a plurality of types of recording paper can be used, it is desirable that an information recording body, such as a bar code and a wireless tag, containing information about the type of paper is attached to the magazine, and by reading the information contained in the information recording body with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is desirably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a flat plane.

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, and a combination of these. In the case of the configuration in which the belt 33 is nipped with the cleaning rollers, it is desirable to make the line velocity of the cleaning rollers different from that of the belt 33 in order to improve the cleaning effect.

The inkjet recording apparatus 10 can comprise a roller nip conveyance mechanism instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is desirable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
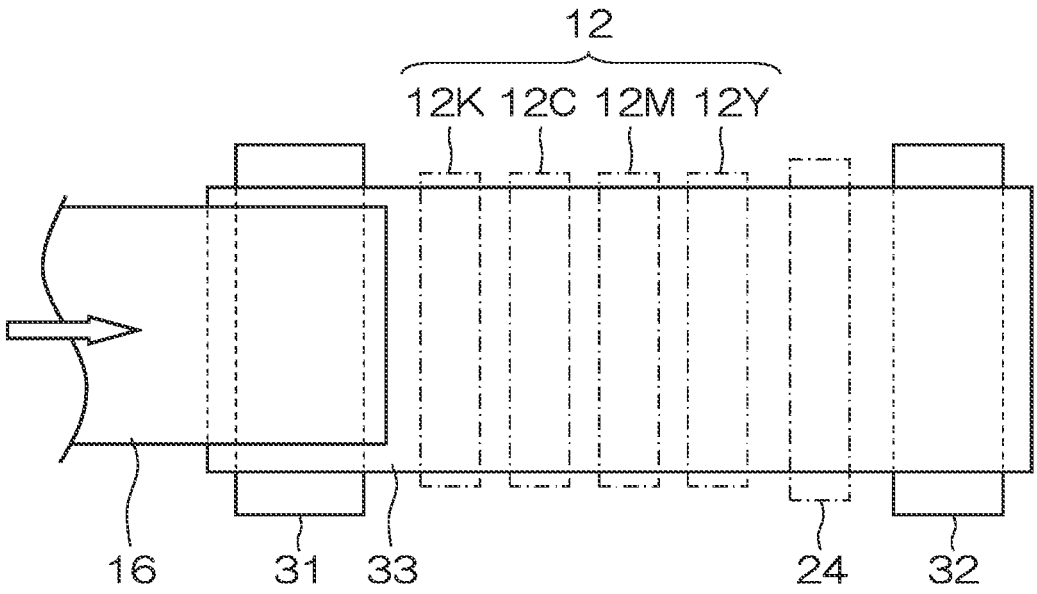
FIG. 2 is a principal plan diagram showing the peripheral area of a print unit of an inkjet recording apparatus.

The print unit 12 is a so-called full line type head in which a line head having a length corresponding to the maximum paper width is arranged in a direction (the main scanning direction) which is perpendicular to the paper feed direction (sub-scanning direction). The heads 12K, 12C, 12M and 12Y which constitute the print unit 12 are constituted by line heads in which a plurality of ink ejection ports (nozzles) are arranged through a length exceeding at least one edge of the maximum size recording medium 16 intended for use with the inkjet recording apparatus 10 (see FIG. 2).

The heads 12K, 12C, 12M and 12Y corresponding to respective colored inks are disposed in the order black (K), cyan (C), magenta (M) and yellow (Y), from the upstream side (the left-hand side in FIG. 1) following the direction of conveyance of the recording paper 16 (the paper conveyance direction). A color print can be formed on the recording paper 16 by ejecting the colored inks respectively from the heads 12K, 12C, 12M and 12Y while conveying the recording paper 16.

By adopting the printing unit 12 in which the full line heads covering the full paper width are provided for the respective colors in this way, it is possible to record an image on the full surface of the recording paper 16 by performing just one operation of relatively moving the recording paper 16 and the printing unit 12 in the paper conveyance direction (sub-scanning direction), in other words, by means of a single sub-scanning action. Higher-speed printing is thereby made possible and productivity can be improved in comparison with a shuttle type head configuration in which a head reciprocates in a direction (main scanning direction) perpendicular to the paper conveyance direction.

Although the configuration with the KCMY four standard colors is described in the present example, combinations of the ink colors and the number of colors are not limited to those. Light inks, dark inks or special color inks can be added as required. For example, a configuration is possible in which heads for ejecting light-colored inks such as light cyan and light magenta are added.

As shown in FIG. 1, the ink storing and loading unit 14 has tanks which store inks of colors corresponding to the heads 12K, 12C, 12M and 12Y respectively, and the tanks are connected respectively to the heads 12K, 12C, 12M and 12Y via channels which are not illustrated. Furthermore, the ink storing and loading unit 14 includes an annunciation device (display device, warning sound generating device, or the like) which issues a corresponding report when the remaining amount of ink has become low, and has a function for preventing incorrect loading between colors.

The print determination unit 24 has an image sensor (line sensor, or the like) for capturing an image of the ink-droplet deposition result of the printing unit 12, and functions as a device to check for ejection defects, such as clogs of the nozzles, from the ink-droplet deposition results evaluated by the image sensor.

The print determination unit 24 of the present example is configured with at least a line sensor having rows of photosensitive elements with a width that is greater than the ink-droplet ejection width (image recording width) of the heads 12K, 12C, 12M, and 12Y. This line sensor has a color separation line CCD sensor including a red (R) sensor row composed of photoelectric transducing elements (pixels) arranged in a line provided with a red (R) color filter, a green (G) sensor row with a green (G) color filter, and a blue (B) sensor row with a blue (B) color filter. Instead of such a line sensor, it is possible to use an area sensor composed of photosensitive elements which are arranged two-dimensionally.

A test pattern printed by the heads 12K, 12C, 12M, and 12Y of the respective colors is read in by the print determination unit 24, and the ejection performed by each head is determined. The ejection determination includes detection of the ejection, measurement of the dot size, and measurement of the dot formation position (dot landing position).

A post-drying unit 42 is disposed following the print determination unit 24. The post-drying unit 42 is a device to dry the printed image surface, and includes a heating fan, for example. It is desirable to avoid contact with the printed surface until the printed ink dries, and a device that blows heated air onto the printed surface is desirable.

In cases in which printing is performed with dye-based ink on porous paper, blocking the pores of the paper by the application of pressure prevents the ink from coming contact with ozone and other substances that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are desirably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed immediately before the paper output unit 26, and is used for separating a test print portion from the target print portion when the test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting image prints according to print orders.

Structure of the Head

Next, the structure of the heads 12K, 12C, 12M and 12Y will be described. Incidentally, the heads 12K, 12C, 12M and 12Y have the same structure, and a reference numeral 50 is hereinafter designated to any of the heads.

Figure 3A:
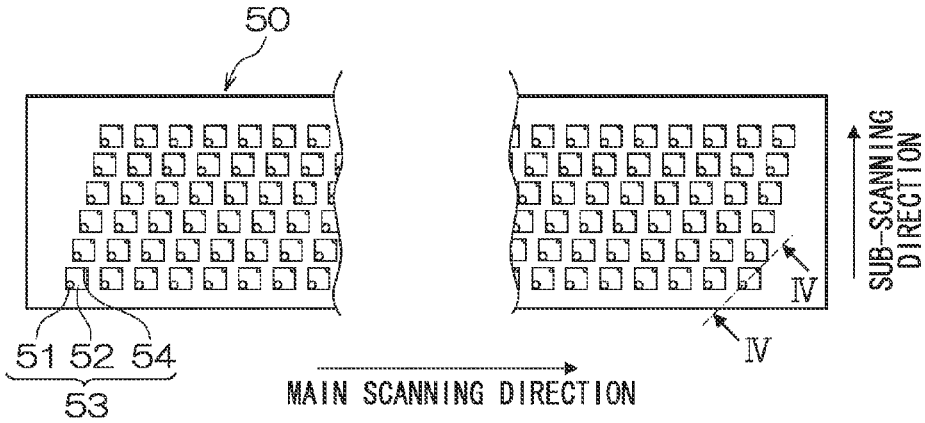
FIGS. 3A to 3C are plan view perspective diagrams showing examples of the composition of a print head.
Figure 3B:
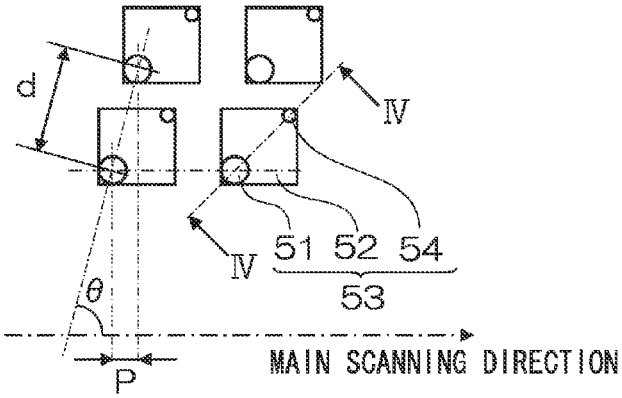
Figure 3C:
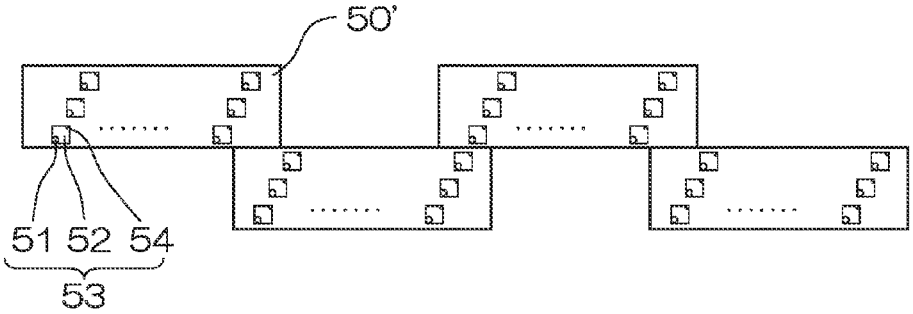
Figure 4:
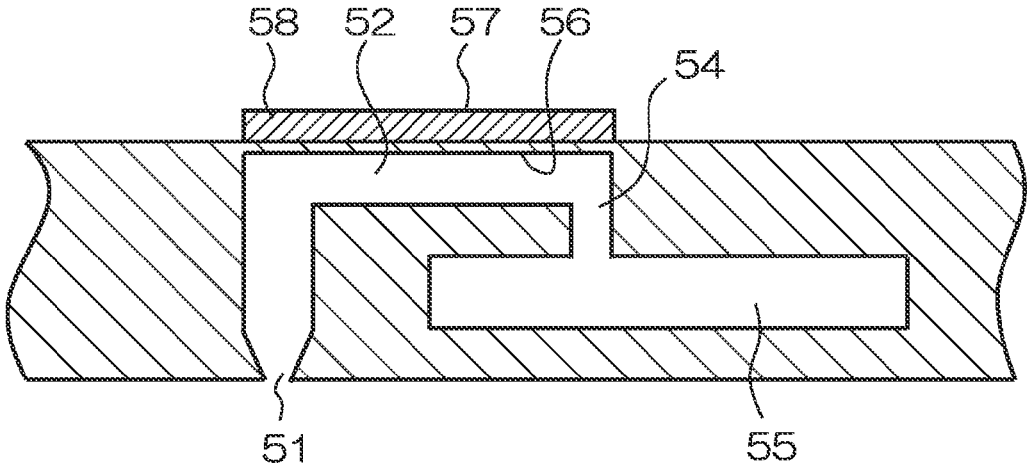
FIG. 4 is a cross-sectional diagram along line IV-IV in FIGS. 3A and 3B, showing the composition of an ink chamber unit.

FIG. 3A is a perspective plan view showing an example of the configuration of a head 50, FIG. 3B is an enlarged view of a portion thereof, and FIG. 3C is a perspective plan view showing another example of the configuration of a head 50. FIG. 4 is a cross-sectional view showing the composition of an ink chamber unit taken along line IV-IV in FIGS. 3A and 3B.

The nozzle pitch in the head 50 should be minimized in order to maximize the density of the dots formed on the surface of the recording paper. As shown in FIGS. 3A and 3B, the head 50 according to the present embodiment has a structure in which a plurality of ink chamber units 53, each comprising a nozzle 51 forming an ink droplet ejection port, a pressure chamber 52 corresponding to the nozzle 51 and the like, are disposed two-dimensionally in the form of a staggered matrix, and hence the effective nozzle interval (the projected nozzle pitch) as projected in the lengthwise direction of the head (the main scanning direction perpendicular to the paper conveyance direction) is reduced and high nozzle density is achieved.

The mode of forming one or more nozzle rows through a length corresponding to the entire width of the recording paper 16 in a direction substantially perpendicular to the paper conveyance direction is not limited to the example described above. For example, instead of the configuration in FIG. 3A, as shown in FIG. 3C, a line head having nozzle rows of a length corresponding to the entire width of the recording paper 16 may be formed by arranging and combining, in a staggered matrix, short head modules (head chips) 50' having a plurality of nozzles 51 arrayed in a two-dimensional fashion. Alternatively, although not shown, a line head may be formed by arranging short heads in one line.

The planar shape of the pressure chamber 52 provided for each nozzle 51 is substantially a square, and the nozzle 51 and an ink inlet 54 are disposed in both corners on a diagonal line of the square. Each pressure chamber 52 is connected to a common channel 55 through the ink inlet 54.

Piezoelectric elements 58 each having an individual electrode 57 are bonded to the diaphragm 56 which constitutes a ceiling face of the pressure chambers 52 and also serves as a common electrode; each piezoelectric element 58 is deformed by applying a drive voltage to the individual electrode 57, thereby pressurizing the ink in the pressure chamber 52, and ink is ejected from a nozzle 51 which is connected to the pressure chamber 52. When ink is ejected, new ink is supplied to the pressure chamber 52 from the common flow channel 55 via the ink inlet 54.

In the present embodiment, a piezoelectric element 58 is employed as an ejection pressure generating device for ink ejected from a nozzle 51 provided in the head 50, but it is also possible to employ a thermal method in which a heater is provided inside a pressure chamber 52, and ink is ejected by using the pressure of film boiling produced by heating by the heater.

As shown in FIG. 3B, the high-density nozzle head according to the present embodiment is achieved by arranging a plurality of ink chamber units 53 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 53 are arranged at a uniform pitch d in line with a direction forming an angle of θ with respect to the main scanning direction, the pitch P of the nozzles projected so as to align in the main scanning direction is $d \times \cos\theta$, and hence the nozzles 51 can be regarded to be equivalent to those arranged linearly at the fixed pitch P along the main scanning direction. By adopting such configuration, it is possible to realize a nozzle structure in which the nozzle row projected in the main scanning direction has a high nozzle density of up to 2,400 nozzles per inch.

In implementing the present invention, the arrangement structure of the nozzles is not limited to the example shown in the drawings and it is possible to adopt various nozzle arrangement structures, such as a configuration having one nozzle row in the sub-scanning direction.

Furthermore, the scope of application of the present invention is not limited to a print method using a line type head, and the present invention may also be applied to a serial method in which printing is performed in the width direction of the recording paper 16 by employing a short head which is shorter than the length in the width direction (main scanning direction) of the recording paper 16 and performing a scanning action of the head in the width direction, and after completing one printing action in the width direction, the recording paper 16 is moved by a prescribed amount in a direction (sub-scanning direction) perpendicular to the width direction, printing in the width direction of the recording paper 16 is performed on the next print region, and by repeating this operation, printing is performed over the whole surface of the print area of the recording paper 16.

Composition of Control System

Figure 5:
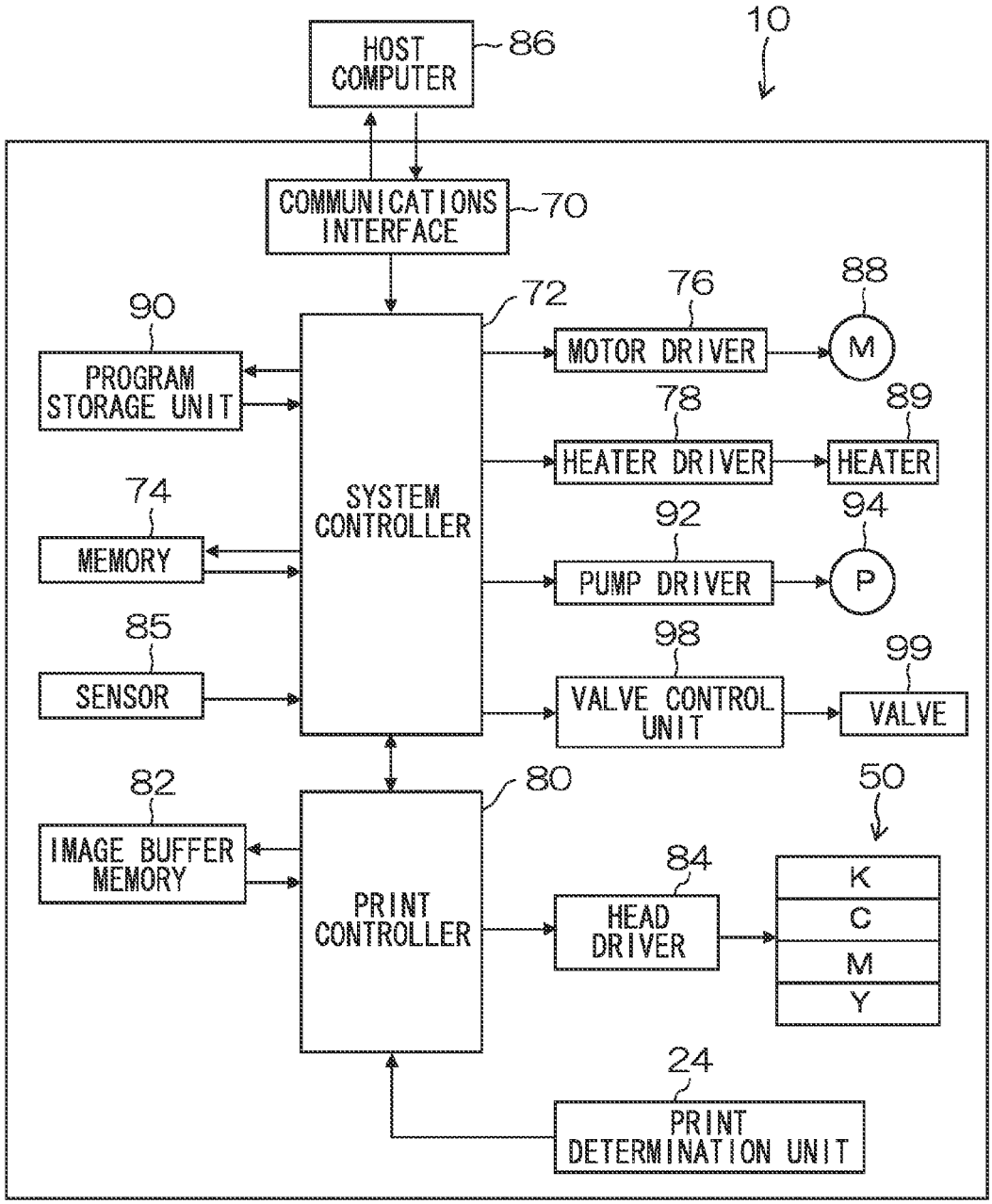
FIG. 5 is a principal block diagram showing a control system of the inkjet recording apparatus.

FIG. 5 is a principal block diagram showing a control system of the inkjet recording apparatus 10. The inkjet recording apparatus 10 comprises a communications interface 70, a system controller 72, a memory 74, a motor driver 76, a heater driver 78, a print controller 80, an image buffer memory 82, a head driver 84, and the like.

The communications interface 70 is an interface unit for receiving image data sent from a host computer 86. A serial interface such as USB (Universal Serial Bus), IEEE1394, Ethernet (registered trademark), wireless network, or a parallel interface such as a Centronics interface may be used as the communications interface 70. A buffer memory (not shown) may be mounted in this portion in order to increase the communication speed.

The image data sent from the host computer 86 is received by the inkjet recording apparatus 10 through the communications interface 70, and is temporarily stored in the memory 74. The memory 74 is a storage device for temporarily storing images inputted through the communications interface 70, and data is written and read to and from the memory 74 through the system controller 72. The memory 74 is not limited to a memory composed of semiconductor elements, and a hard disk drive or another magnetic medium may be used.

The system controller 72 is a control unit which controls the respective units of the communications interface 70, the memory 74, the motor driver 76, the heater driver 78, and the like. The system controller 72 is constituted by a central processing unit (CPU), peripheral circuits thereof and the like, controls communications with the host computer 86 and writing and reading to and from the memory 74, and also generates control signals for controlling the motors 88 of the conveyance system and heaters 89.

Programs executed by the CPU of the system controller 72 and the various types of data which are required for control procedures are stored in the memory 74. The memory 74 may be a non-writeable storage device, or it may be a rewriteable storage device, such as an EEPROM. The memory 74 is used as a temporary storage region for the image data, and it is also used as a program development region and a calculation work region for the CPU.

Control programs of various types are stored in the program storage unit 90, and the control programs are read out and executed in accordance with instructions from the system controller 72. The program storage unit 90 may employ a semiconductor memory, such as a ROM or EEPROM, or may use a magnetic disk, or the like. An external interface may be provided and a memory card or PC card may be used. Of course, it is also possible to provide a plurality of recording media, of these recording media. The program storage unit 90 may also serve as a recording device (not illustrated) for operating parameters, and the like.

The motor driver (drive circuit) 76 drives the motors 88 in accordance with commands from the system controller 72. The heater driver (drive circuit) 78 drives the heaters 89 of the post-drying unit 42 and other respective units in accordance with commands from the system controller 72.

The pump driver 92 is a driver which drives the pump 94 in accordance with instructions from the system controller 72. The pump 94 shown in FIG. 5 includes the supply pump 104 shown in FIG. 6, the supply pump 208 shown in FIG. 9 and the recovery pump 210.

The valve control unit 98 controls the valve 99 in accordance with an instruction from the system controller 72. The valve 99 shown in FIG. 5 includes the head valve 108 shown in FIG. 6, and the head valve 218 and the bypass valve 220 shown in FIG. 9.

The sensor 85 includes various sensors which are provided in the respective units of the apparatus, such as pressure sensors, temperature sensors, position determination sensors, and the like. The pressure sensors include the pressure sensor 106A and 106B in FIG. 6 and the pressure sensors 216A and 216B in FIG. 9. The output signals from the sensors 85 are sent to the system controller 72 and the system controller 72 sends control signals to the respective units of the apparatus on the basis of these output signals, thereby controlling the respective units of the apparatus.

The print controller 80 has a signal processing function for performing various tasks, compensations, and other types of processing for generating print control signals from image data stored in the memory 74 in accordance with commands from the system controller 72 so as to supply the generated print control signals (dot data) to the head driver 84. Required signal processing is carried out in the print controller 80, and the ejection droplet amount and the ejection timing of the ink droplets from the respective print heads 50 are controlled via the head driver 84, on the basis of the print data. By this means, desired dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 5 is one in which the image buffer memory 82 accompanies the print controller 80; however, the memory 74 may also serve as the image buffer memory 82. Also possible is an aspect in which the print controller 80 and the system controller 72 are integrated to form a single processor.

The head driver 84 generates drive signals for driving the piezoelectric elements 58 (see FIG. 4) of the heads 50 of the respective colors, on the basis of dot data supplied from the print controller 80, and supplies the generated drive signals to the piezoelectric elements 58. The head driver 84 may also be incorporated with a feedback control system for maintaining uniform drive conditions in the heads 50.

The print determination unit 24 is a block that includes a line sensor as described above with reference to FIG. 1, reads the image printed on the recording paper 16, performs required signal processing, and the like, to determine the print conditions (presence of the ejection, variation in the dot formation, and the like), and provides the determination results of the print conditions to the print controller 80.

According to requirements, the print controller 80 makes various corrections with respect to the head 50 on the basis of information obtained from the print determination unit 24.

Composition of Ink Supply System

Figure 6:
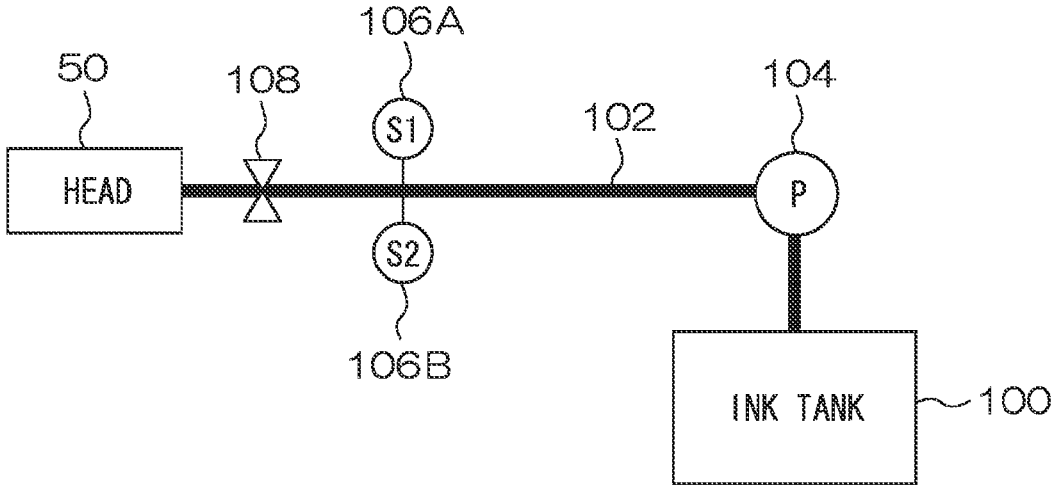
FIG. 6 is a schematic drawing showing an example of the composition of an ink supply system according to a first embodiment.

FIG. 6 is a schematic drawing showing the principal composition of an ink supply system of an inkjet recording apparatus 10. In FIG. 6, in order to simplify the description, the ink supply system relating to only one color is depicted, but in the case of a plurality of colors, a plurality of similar compositions are provided. Furthermore, the head 50 shown in FIG. 6 may of course be constituted by a plurality of head modules 50' (see FIG. 3C) as described above.

As shown in FIG. 6, the ink supply system (ink supply apparatus) of the inkjet recording apparatus 10 principally comprises an ink tank 100, a supply flow channel 102, a supply pump 104, a first pressure sensor 106A, a second pressure sensor 106B and a head valve 108.

The ink tank 100 is a base tank (ink supply source) which accommodates ink to be supplied to the head 50, and corresponds to a tank which is disposed in the ink storage and loading unit 14 shown in FIG. 1.

The supply flow channel 102 is a liquid flow channel (ink supply channel) which connects the ink tank 100 with the head 50, and a supply pump 104 (corresponding to the "pressure change application device" of the present invention) is disposed at an intermediate point of this flow channel. The supply pump 104 is a liquid pump capable of being driven in both directions (forward direction and reverse direction), and the driving thereof is controlled by the system controller 72 via the pump driver 92 shown in FIG. 5. For example, if the supply pump 104 is driven in the forward direction, then ink is supplied from the ink tank 100 to the head 50 via the supply flow channel 102.

The head valve 108 is provided to the downstream side (head 50 side) of the supply pump 104 in the supply flow channel 102. The head valve 108 is a flow channel opening and closing device which is configured so as to be capable of opening and closing the supply flow channel 102, and the opening and closing operation of this valve is controlled by the system controller 72 which is shown in FIG. 5. When the head valve 108 is in an open state, ink can be supplied from the ink tank 100 to the head 50, and when the valve is closed, then ink cannot be supplied.

There are no particular restrictions on the head valve 108, but an electromagnetic valve may be desirably used as the head valve 108. In a mode using such an electromagnetic valve, compared to a valve based on another system (for example, an electrically-operated valve), it is possible to transfer the supply flow channel 102 instantaneously from an open state to a closed state during a halt process carried out when an abnormality is detected, and therefore trouble such as ink leaking can be prevented rapidly and reliably.

A first and a second pressure sensor 106A and 106B are provided between the supply valve 104 and the head valve 108 in the supply flow channel 102. These pressure sensors 106A and 106B are pressure measurement devices which measure the liquid pressure (ink pressure) in the supply flow channel 102, and the liquid pressures (measurement values) measured by these respective sensors are reported (sent) to the system controller 72 shown in FIG. 5. The system controller 72 controls the pressure in such a manner that a desired pressure differential is achieved between the ink tank 100 and the head 50 by controlling the driving of the supply pump 104 on the basis of the liquid pressure measured by the first pressure sensor 106A (or the second pressure sensor 106B), as described below.

The first pressure sensor 106A is a main pressure sensor which is used at all times during the main operation of the inkjet recording apparatus 10, and the second pressure sensor 106B is a reserve pressure sensor which is used when the first pressure sensor 106A has broken down. In the abnormality judgment and abnormal location identification for an ink supply system described below, abnormality judgment, and the like, is carried out on the basis of the measurement values of the first and second pressure sensors 106A and 106B. The abnormality judgment and the abnormal location identification for the ink supply system are carried out by the system controller 72 shown in FIG. 5.

The measurement positions of the liquid pressure in the supply flow channel 102 by the first and the second pressure sensors 106A and 106B do not necessarily have to be the same position. However, from the viewpoint of achieving stable pressure control when using either the main pressure sensor or the reserve pressure sensor, as well as achieving more accurate abnormality judgment and abnormal location identification of the ink supply system described below, it is desirable that the liquid pressure measurement positions of the first and second pressure sensors 106A and 106B in the supply flow channel 102 should be the same position.

In an ink supply operation of the ink supply system when a print operation is being performed by the inkjet recording apparatus 10, the system controller 72 opens the head valve 108 and controls the driving of the supply pump 104 so as to supply ink from the ink tank 100 to the head 50 via the supply flow channel 102. In this case, the liquid pressure in the supply flow channel 102 is measured by the first pressure sensor 106A (or the second pressure sensor 106B), and the measurement result is reported to the system controller 72. The system controller 72 controls the driving of the supply pump 104 in such a manner that the measurement value obtained by the first pressure sensor 106A (or the second pressure sensor 106B) approaches the prescribed reference pressure (target pressure). By this means, ink is supplied from the ink tank 100 to the head 50 in accordance with the amount of ink consumed by the head 50 as a result of ink ejection.

In the present embodiment, processing is carried out for abnormality judgment and abnormal location identification before the start of the main operation of the ink supply system.

Figure 7:
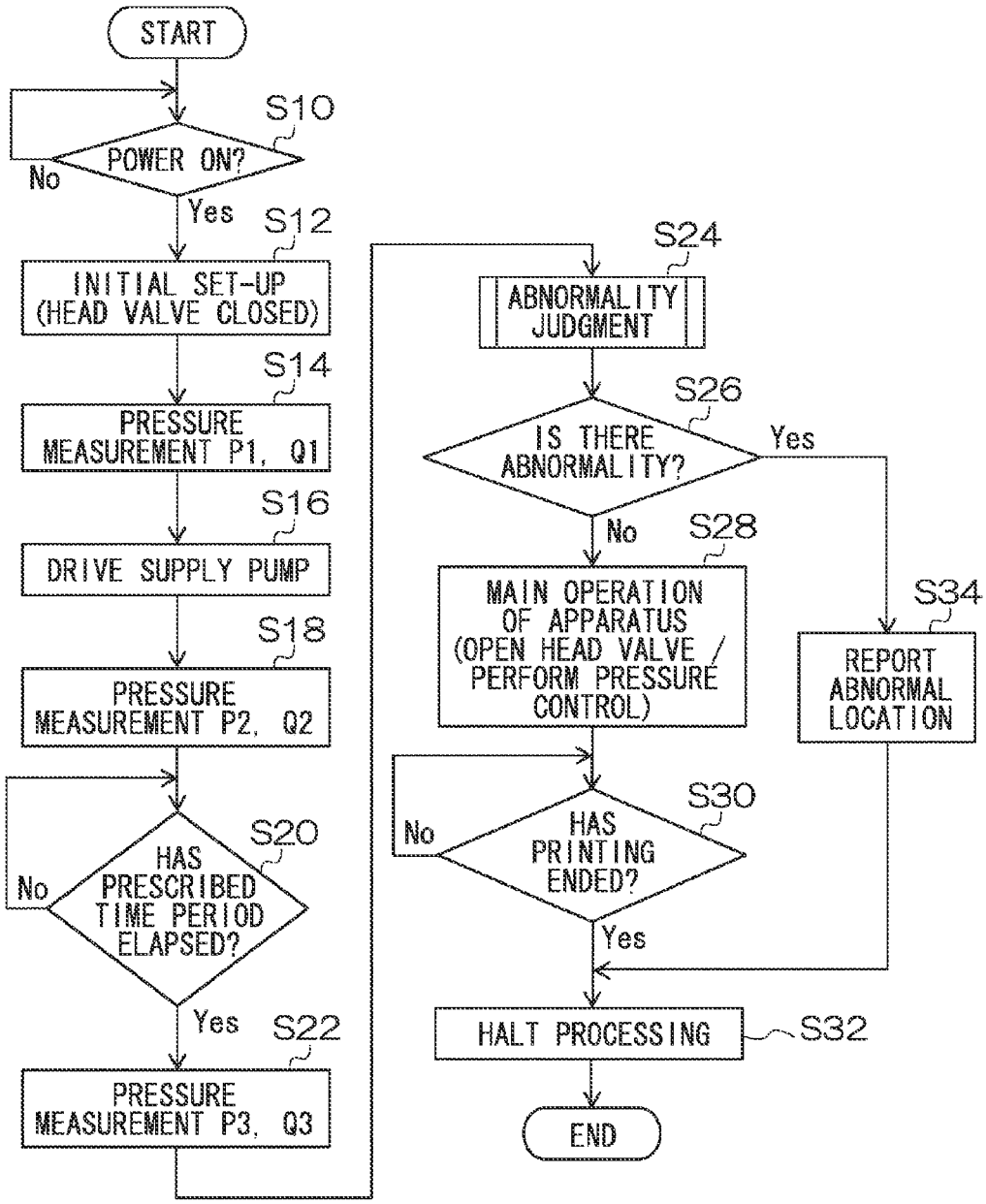
FIG. 7 is a flow chart showing one example of an operational sequence of the ink supply system according to the first embodiment.

FIG. 7 is a flow chart showing one example of an operational sequence of an ink supply system according to a first embodiment. FIG. 8 is an abnormal location identification judgment table which is used to identify the location of an abnormality in the flowchart in FIG. 7. Below, a process for carrying out abnormality judgment and abnormal location identification in the present embodiment is described with reference to FIG. 7 and FIG. 8. Unless specified otherwise, the respective processes in the flowchart shown in FIG. 7 are carried out by the system controller 72 shown in FIG. 5.

As shown in FIG. 7, firstly, it is judged whether or not the power supply (of the ink supply system) has been switched on (step S10). If the power supply is in the on-state, then the sequence advances to the next step, S12. On the other hand, if the power supply is in the off-state, then the judgment in step S10 is repeated until the power supply is switched on.

If it is judged at step S10 that the power supply is on, then initial setup of the ink supply system is carried out (step S12). This initial setup includes processing for closing all valves (including the head valve 108).

Thereupon, the liquid pressure inside the supply flow channel 102 is measured by the first and second pressure sensors 106A and 106B (step S14). In this case, the liquid pressures (pressure before liquid conveyance) measured by the first and second pressure sensors 106A and 106B are respectively called P1 and Q1.

Thereupon, the supply pump 104 is driven in the forward direction for a certain period of time (CW driving) (step S16). By this means, the ink accommodated inside the ink tank 100 is conveyed into the supply flow channel 102 (between the ink tank 100 and the head valve 108) in a forward direction (the direction from the ink tank 100 toward the head 50).

In this case, a desirable mode is one where the supply pump 104 is driven in such a manner that ink of the minimum amount necessary to enable measurement of the liquid pressure in the supply flow channel 102 by the first and second pressure sensors 106A and 106B is conveyed into the supply flow channel 102. For example, the drive conditions of the supply pump 104 (number of revolutions and drive time, etc.) which permit the pressure sensors 106A and 106B to measure the liquid pressure stably are determined in advance on the basis of experimentation, or the like, and the supply pump 104 is driven according to these conditions.

The driving of the supply pump 104 which has been driven for a prescribed period of time in this way is halted, whereupon the liquid pressure in the supply flow channel 102 is measured by the first and second pressure sensor 106A and 106B (step S18). In this case, the liquid pressures (pressure after conveyance of liquid) measured by the first and second pressure sensors 106A and 106B are respectively called P2 and Q2.

It is then judged whether or not a prescribed period of time has elapsed (step S20). Here, the apparatus assumes a standby state from the completion of the preceding step S18 until a prescribed time period has elapsed. The prescribed time period set in this step is a necessary and sufficient time required in order to judge whether or not ink leaking has occurred on the basis of the change in the liquid pressure, and this time period is determined experimentally or empirically. The judgment in step S20 is repeated until the prescribed time period has elapsed, and when the prescribed time period has elapsed, the sequence advances to the next step, S22.

Subsequently, the liquid pressure in the supply flow channel 102 is measured by the first and second pressure sensors 106A and 106B (step S22). In this step, the liquid pressures (pressure after standby) measured by the first and second pressure sensors 106A and 106B are respectively called P3 and Q3.

Next, abnormality judgment processing is carried out (step S24). Here, abnormality judgment and abnormal location identification for the ink supply system are carried out in accordance with the abnormality judgment identification and judgment table shown in FIG. 8, using the liquid pressure values P1 to P3 and Q1 to Q3 measured in the preceding steps S14, S18 and S22.

More specifically, as shown in FIG. 8, abnormality judgment and abnormal location identification are carried out on the basis of whether or not the following conditions M1 to M4 are established. In FIG. 8, a case where the respective condition is established is indicated with the term of "SATISFIED", and a case where it is not established is indicated with the term of "UNSATISFIED".

| | |
|---|---|
| $P2>P1$ | Condition M1 |
| $Q2>Q1$ | Condition M2 |
| $P2\approx P3$ | Condition M3 |
| $Q2\approx Q3$ | Condition M4 |

In the conditions M3 and M4 given above, the range in which substantially the same value is obtained for the liquid pressure on the left-hand side of the equation and the liquid pressure on the right-hand side of the conditions is the variation tolerance range of the liquid pressure when there is no leaking of ink in the supply flow channel 102. In the present embodiment, the liquid pressures are taken to be substantially the same provided that the liquid pressure on the right-hand side is in the range of 90% to 110% (and desirably 95% to 105%) of the liquid pressure on the left-hand side.

Here, the correspondence between the establishment of the conditions M1 to M4 and abnormal location will be described.

Firstly, if all of the conditions M1 to M4 are established (i.e. the case of PT1 in FIG. 8), then the liquid pressure in the supply flow channel 102 after liquid conveyance after driving the supply pump 104 is higher than the liquid pressure before liquid conveyance before driving the supply pump 104, and furthermore the pressure after liquid supply is substantially equal to the pressure after standby which is obtained after waiting for a prescribed period of time. In this case, the change in the liquid pressure in the supply flow channel 102 due to the driving of the supply pump 104 is appropriate, and it is judged that the ink supply system is operating normally.

On the other hand, if the condition M1 is not established and the condition M2 is established (i.e. the case of PT2 in FIG. 8), then it is inferred that pressure measurement by the first pressure sensor 106A is not possible or that the liquid pressure measured by the first pressure sensor 106A is indicating an abnormal value, and regardless of whether or not the condition M3 is established, the first pressure sensor 106A is identified as the location of an abnormality.

If, conversely to the situation mentioned above, the condition M1 is established and the condition M2 is not established (in the case of PT3 in FIG. 8), then it is inferred that pressure measurement by the second pressure sensor 106B is not possible or that the liquid pressure measured by the second pressure sensor 106B is indicating an abnormal value, and regardless of whether or not the condition M4 is established, the second pressure sensor 106B is identified as the location of an abnormality.

Moreover, a case where the conditions M3 and M4 are not established (the case of PT4 in FIG. 8) is a case where the liquid pressure in the supply flow channel 102 after halting of the driving of the supply pump 104 declines over the passage of time, and therefore it is inferred that an ink leak has occurred in the supply flow channel 102, and the supply flow channel 102 is identified as the location of the abnormality.

Furthermore, if the conditions M1 and M2 are not established (i.e. the case of PT5 in FIG. 8), regardless of whether or not the conditions M3 and M4 are established, it is inferred that either the supply pump 104 has broken down, or that a blockage has occurred in the supply flow channel 102, and the supply pump 104 or the supply flow channel 102 is identified as the location of the abnormality.

If the conditions M1 and M2 are not established, then there is a possibility that the first and second pressure sensors 106A and 106B have broken down simultaneously, but this possibility is sufficiently low and therefore such a situation is handled as shown in FIG. 8 in the present embodiment.

After the abnormality judgment processing has been carried out in this way, it is judged whether or not there is an abnormality in the ink supply system on the basis of these judgment results (step S26). If there is no abnormality, the procedure then advances to step S28, whereas if there is an abnormality, then the procedure advances to step S34.

If it is judged in the preceding step S26 that there is no abnormality in the ink supply system, then the main operation of the ink supply system is started (step S28). In this case, the system controller 72 sets the head valve 108 to an open state and controls the driving of the supply pump 104 in such a manner that the liquid pressure measured by the first pressure sensor 106A (or the second pressure sensor 106B) approaches the prescribed reference pressure (target pressure). By this means, ink is supplied from the ink tank 100 to the head 50 via the supply flow channel 102 in accordance with the amount of ink consumed by the head 50 as a result of ink ejection operation.

Subsequently, it is judged whether or not printing has ended (step S30). If printing has not ended, then the judgment in step S30 is repeated until printing has ended. If printing has ended, then an ink supply system halting process is carried out (step S32).

On the other hand, if it is judged in the preceding step S26 that there is an abnormality in the ink supply system, then an abnormal location report is issued (step S34). There are no particular restrictions on the mode of reporting an abnormal location, provided that the mode enables the user to recognize the abnormal location in the ink supply system; however, it is desirable to adopt a mode in which the abnormal location is indicated by using text, symbols or figures, or the like, on a display device (not illustrated) accompanying the host computer 86 in FIG. 5, for example. After the abnormal location report has been issued, an ink supply system halting process is carried out (step S32).

As described above, according to the first embodiment, in the ink supply system which supplies ink from an ink tank 100 to a head 50 via a supply flow channel 102, a pressure change is applied to the supply flow channel 102 due to the driving of the supply pump 104 and the pressure in the supply flow channel 102 before and after driving of the pump (before and after the pressure change) is measured by the first and second pressure sensors 106A and 106B. By comparing the direction in which the pressure change is applied by the supply pump 104 with the direction of the change of the measurement values of the first and second pressure sensors 106A and 106B, it is possible to judge the presence or absence of an abnormality in the ink supply system, as well as identifying the abnormal location. By this means, if there is an abnormality in the ink supply system, then it is possible to restore the system rapidly, and hence stable and highly reliable ink supply can be achieved. Furthermore, it is also possible to ensure stable printing in the inkjet recording apparatus 10.

Moreover, a desirable mode is one where, as in the present embodiment, a process of performing abnormality judgment and abnormal location identification in the ink supply system is carried out before starting the main operation of the ink supply system. It is also possible to prevent problems, such as ink leaks, in advance.

Second Embodiment

Next, a second embodiment of the present invention will be described. Below, portions which are common with the first embodiment are not explained further, and the following description centers on the characteristic features of the present embodiment.

Figure 9:
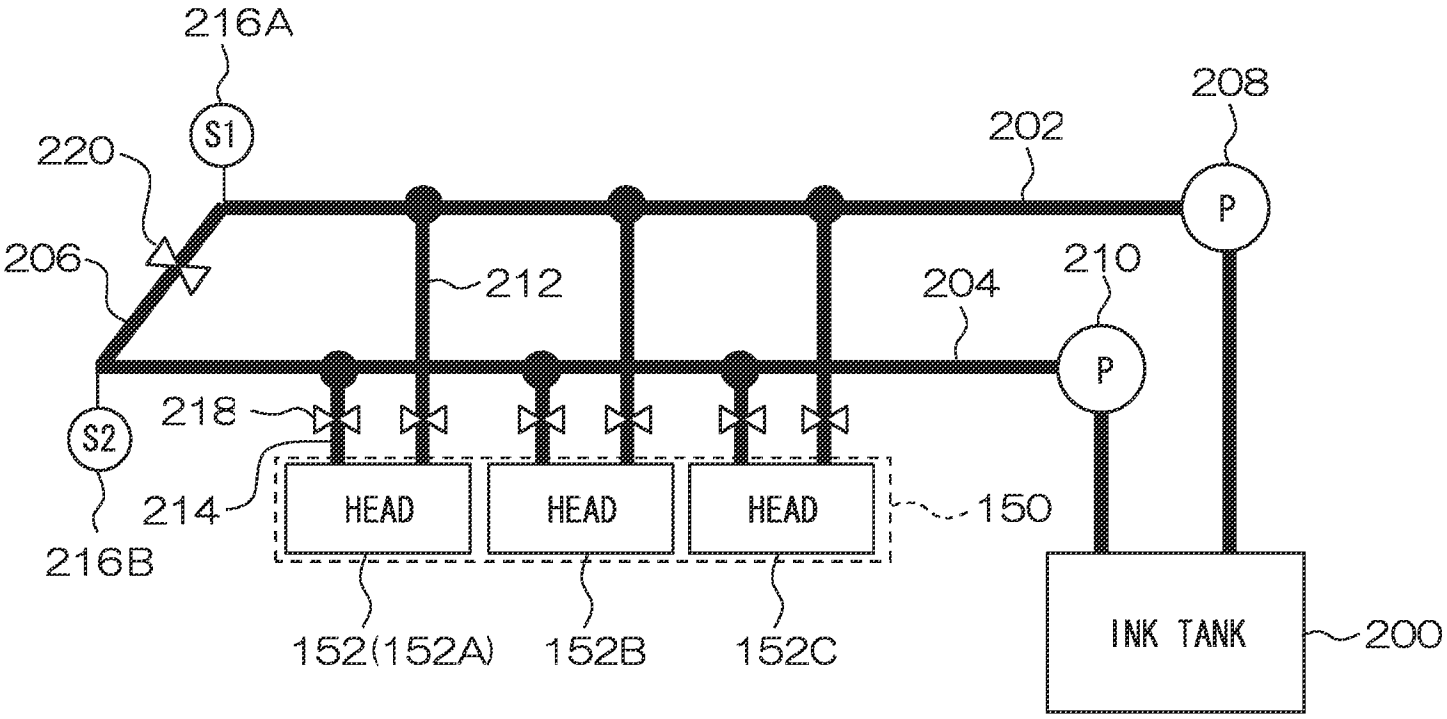
FIG. 9 is a schematic drawing showing an example of the composition of an ink supply system according to a second embodiment.

FIG. 9 is a schematic drawing showing the principal composition of an ink supply system according to the second embodiment. In FIG. 9, in order to simplify the description, the ink supply system relating to only one color is depicted, but in the case of a plurality of colors, a plurality of similar compositions are provided.

As shown in FIG. 9, the head 150 used in the second embodiment is constituted by a plurality of head modules 152 (152A, 152B, 152C). Although not shown in the drawings, similarly to the head 50 described in relation to the first embodiment, the head modules 152 are also provided with nozzles, pressure chambers, piezoelectric elements and a common flow channel, the ink inside the pressure chambers being pressurized by deformation of the piezoelectric elements and being ejected from the nozzles which are connected to the pressure chambers.

Furthermore, each head module 152 is also provided with an inlet port for introducing ink supplied from the ink supply system to the interior of the head (to the ink flow channels such as the pressure chambers and the common flow channel), and an outlet port for discharging, to the exterior of the head, ink which has been circulated inside the head without being ejected from the nozzles after being introduced via the inlet port.

The ink supply system (ink supply apparatus) relating to the present embodiment is principally constituted by an ink tank 200, a supply flow channel 202, a recovery flow channel 204, a bypass flow channel 206, a supply pump 208, a recovery pump 210, branch flow channels 212, 214, a first pressure sensor 216A, a second pressure sensor 216B, a head valve 218 and a bypass valve 220.

The supply flow channel 202 is a main flow channel for supplying ink to the supply port of each head module 152, and one end thereof is connected to an ink tank 200. On the other end side of the supply flow channel 202 (on the side opposite to the ink tank 200), a plurality of branch flow channels 212 are branched off (connected to the supply flow channel 202) and the front end of each branch flow channel 212 is connected to the supply port of the corresponding head module 152.

A supply pump 208 is provided in the supply flow channel 202, nearer to the ink tank 200 than the positions where the branch flow channels 212 branch off. The supply pump 208 is a liquid pump capable of being driven in both directions (forward direction and reverse direction), and the driving thereof is controlled by the system controller 72 via the pump driver 92 shown in FIG. 5. For example, if the supply pump 104 is driven in the forward direction, then ink is supplied from the ink tank 100 to the respective head modules 152 via the supply flow channel 202 and the branch flow channels 212.

The recovery flow channel 204 is a main flow channel for recovering ink which is discharged from the outlet port of each head module 152, and one end thereof is connected to the ink tank 200. On the other end side of the recovery flow channel 204 (on the side opposite to the ink tank 200), a plurality of branch flow channels 214 are branched off (connected to the recovery flow channel 204) and the front end of each branch flow channel 214 is connected to the outlet port of the corresponding head module 152.

A recovery pump 210 is provided in the recovery flow channel 204, nearer to the ink tank 200 than the position where the branch flow channels 214 branch off. Similarly to the supply pump 208 described above, the recovery pump 210 is a liquid pump capable of being driven in both directions (forward direction and reverse direction), and the driving thereof is controlled by the system controller 72 via the pump driver 92 shown in FIG. 5. For example, when the recovery pump 210 is driven in the forward direction, ink is recovered from the head modules 152 to the ink tank 200 via the branch flow channels 214 and the recovery flow channel 204.

Head valves 218 are provided in the respective branch flow channels 212 and 214. The head valves 218 are flow channel opening and closing devices which are configured so as to be capable of opening and closing the corresponding branch flow channels 212 and 214 respectively, and the opening and closing operation of these valves is controlled by the system controller 72 which is shown in FIG. 5. The system controller 72 is able to cause the ink to circulate individually in each of the head modules 152, by selectively opening and closing the head valves 218.

The first pressure sensor 216A is a pressure measurement device which measures the liquid pressure in the supply flow channel 202, and is provided at the other end of the supply flow channel 202 (the end opposite to the ink tank 200). Furthermore, the second pressure sensor 216B is a pressure measurement device which measures the liquid pressure in the recovery flow channel 204, and is provided at the other end of the recovery flow channel 204 (the end opposite to the ink tank 200). The liquid pressures (measurement values) measured by the pressure sensors 216A and 216B are reported to the system controller 72 shown in FIG. 5. The system controller 72 controls the driving of the supply pump 208 and the recovery pump 210 on the basis of the liquid pressure measured by the first and second pressure sensors 216A and 216B so as to control the pressure in such a manner that the liquid pressure in the supply flow channel 202 and the recovery flow channel 204 assumes a prescribed reference pressure (target pressure).

Here, the pressure control carried out in the present embodiment will be described.

In the present embodiment, ink is supplied from the ink tank 200 to the supply ports of the head modules 152 via the supply flow channel 202 and the branch flow channels 212, by means of pressure control implemented by the system controller 72. The ink supplied to the head modules 152 is circulated along the ink flow channels (the common flow channel, pressure chambers, nozzle flow channels, and the like) formed inside the head modules 152, and a portion of the ink is ejected from nozzles (ejection ports), while the remainder of the ink is discharged from the outlet ports. The ink discharged from the outlet ports of the head modules 152 is recovered to the ink tank 200 via the branch flow channels 214 and the recovery flow channel 204, and is then circulated again to the head modules 152 from the ink tank 200.

In order to achieve ink circulation of this kind, the system controller 72 controls the driving of the supply pump 208 and the recovery pump 210 in such a manner that a prescribed back pressure (negative pressure) is applied to the ink inside the head modules 152 and the liquid pressure in the supply flow channel 202 is relatively higher than the liquid pressure in the recovery flow channel 204.

Here, the supply flow channel 202 is pressurized if the supply pump 208 is driven in the forward direction, and the supply flow channel 202 is depressurized if the supply pump 208 is driven in the reverse direction. On the other hand, the recovery flow channel 204 is depressurized when the recovery pump 210 is driven in the forward direction, and the recovery flow channel 204 is pressurized when the recovery pump 210 is driven in the reverse direction.

More specifically, taking the liquid pressure in the supply flow channel 202 (reference pressure) to be P1, taking the liquid pressure in the recovery flow channel 204 (reference pressure) to be P2, taking the liquid pressure in the head modules 152 (back pressure) to be P0 (where P0 is equal to or lower than atmospheric pressure), taking the pressure differential caused by the height difference between the supply flow channel 202 and the head modules 152 to be ΔP1, and taking the pressure differential caused by the height difference between the recovery flow channel 204 and the head modules 152 to be ΔP2, then the system controller 72 controls the driving of the supply pump 208 and the recovery pump 210 in such a manner that the liquid pressures in the supply flow channel 202 and the recovery flow channel 204 as measured by the first and second pressure sensor 216A and 216B approach liquid pressures P1 and P2 which satisfy the following condition (1):

$$P1+\Delta P1>P0>P2+\Delta P2 \qquad \text{Condition (1)}$$

By controlling the pressure in this way, it is possible to achieve a circulation of ink at all times inside the head modules 152 (and in particular in the vicinity of the nozzles), irrespective of whether or not the head modules 152 are performing an ink ejection operation. Accordingly, it is possible to prevent ejection defects caused by increased viscosity of the ink, or the like, and good print quality can be maintained over a long period of time.

In an ink supply system which performs ink circulation as in the present embodiment, as the number of head modules 152 becomes greater, the flow channel length of the supply flow channel 202 and the recovery flow channel 204 becomes longer, and there is a tendency for the pressure loss to rise. Therefore, a large relative pressure differential occurs between the head modules 152 on the side close to the ink tank 200 and the head modules 152 on the opposite side (the side distance from the ink tank 200), and this may affect image quality by giving rise to density non-uniformities, and the like, due to variation in the ejection of ink from the head modules 152.

Therefore, in the present embodiment, a bypass flow channel 206 is provided in order to eliminate relative pressure differentials between the head modules 152. This bypass flow channel 206 is a flow channel which connects together the other ends of the supply flow channel 202 and the recovery flow channel 204, in such a manner that a portion of the ink supplied from the ink tank 200 via the supply flow channel 202 is guided directly into the recovery flow channel 204 by passing along the bypass flow channel 206, without being introduced into the head modules 152.

A bypass valve 220 forming a flow channel opening and closing device configured so as to be able to open and close the bypass flow channel 206 is provided in the bypass flow channel 206. The opening and closing operation of the bypass valve 220 is controlled by the system controller 72 which is shown in FIG. 5. According to a composition which includes a bypass valve 220 in the bypass flow channel 206 in this way, it is possible to selectively circulate ink along the bypass flow channel 206. By this means, if the number of head modules 152 is small and the pressure differential between head modules 152 is small and not liable to affect ink ejection, then it is possible to halt the circulation of ink via the bypass flow channel 206 and thus improve the ink circulation efficiency between the ink tank 200 and the head modules 152.

Figure 10:
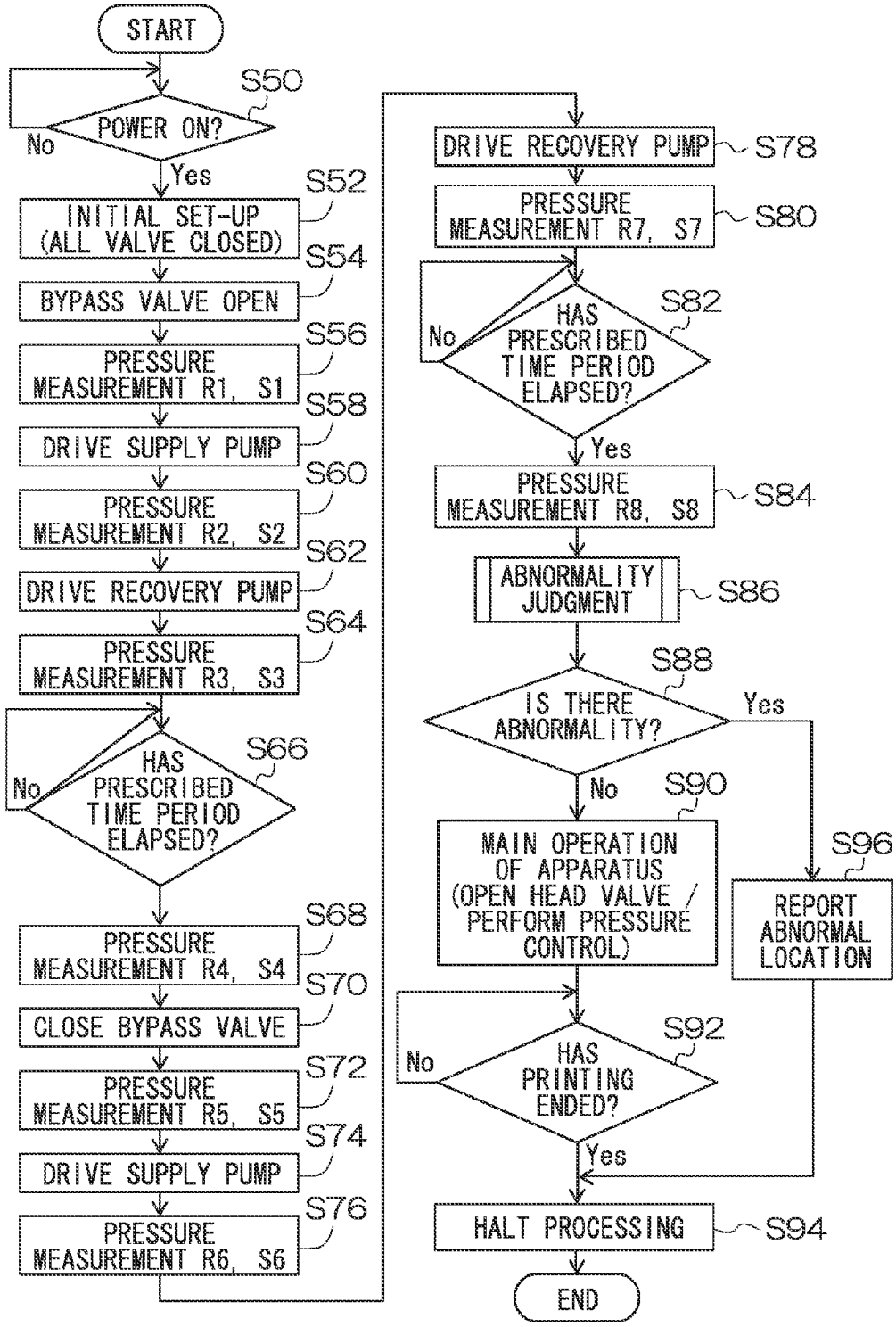
FIG. 10 is a flow chart showing one example of an operational sequence of the ink supply system according to the second embodiment.

FIG. 10 is a flow chart showing one example of an operational sequence of an ink supply system according to the second embodiment. FIG. 11 is an abnormal location identification judgment table which is used to identify the location of an abnormality in the flowchart in FIG. 10. In the following description, processing similar to that of the first embodiment is only explained briefly.

As shown in FIG. 10, firstly, it is judged whether or not the power source (of the ink supply system) is switched on (step S50). If the power is in the off-state, then the judgment in step S50 is repeated until the power is switched on, and if the power is in the on-state, then initial setup of the ink supply system is carried out (step S52). This initial setup includes processing for closing all valves including the head valve 218 and the bypass valve 220.

Thereupon, the bypass valve 220 is opened (step S54), and the liquid pressure in the supply flow channel 202 and the recovery flow channel 204 is measured by the first and the second pressure sensors 216A and 216B respectively (step S56). In this step, the liquid pressures (pressures before liquid conveyance) measured by the first and second pressure sensors 216A and 216B are respectively called R1 and S1.

Thereupon, the supply pump 208 is driven in the forward direction for a certain period of time (CW driving) (step S58). By this means, the ink accommodated in the ink tank 200 is conveyed in a forward direction (a direction from the supply flow channel 202, via the bypass flow channel 206, toward the recovery flow channel 204). Thereupon, the driving of the supply pump 208 is halted, and then the liquid pressure in the supply flow channel 202 and the recovery flow channel 204 is measured by the first and the second pressure sensors 216A and 216B respectively (step S60). In this step, the liquid pressures (pressures after liquid conveyance in the forward direction) measured by the first and second pressure sensors 216A and 216B are respectively called R2 and S2.

Thereupon, the recovery pump 210 is driven in the reverse direction for a certain period of time (CCW driving) (step S62). By this means, the ink accommodated in the ink tank 200 is conveyed in a reverse direction (a direction from the recovery flow channel 204, via the bypass flow channel 206, toward the supply flow channel 202). Thereupon, the driving of the recovery pump 210 is halted, and the liquid pressure in the supply flow channel 202 and the recovery flow channel 204 is measured by the first and the second pressure sensors 216A and 216B respectively (step S64). In this step, the liquid pressures (pressures after liquid conveyance in the reverse direction) measured by the first and second pressure sensors 216A and 216B are respectively called R3 and S3.

It is then judged whether or not a prescribed period of time has elapsed (step S66). Here, the apparatus assumes a standby state from the completion of the preceding step S64 until a prescribed time period has elapsed. Similarly to the first embodiment, the prescribed time period set in this step is a necessary and sufficient time required in order to judge whether or not ink leaking has occurred from the change in the liquid pressure, and is a value which is determined experimentally or empirically. Thereupon, when the prescribed period of time has elapsed, the liquid pressure in the supply flow channel 202 and the recovery flow channel 204 is measured by the first and the second pressure sensors 216A and 216B respectively (step S68). In this step, the liquid pressures (pressure after standby) measured by the first and second pressure sensors 216A and 216B are respectively called R4 and S4.

Thereupon, the bypass valve 220 is closed (step S70). Processing similar to that in steps S56 to S68 described above is then repeated (step S72 to step S84).

In other words, the bypass valve 220 is closed, and then the liquid pressures (pressures before liquid conveyance) R5, S5 in the supply flow channel 202 and the recovery flow channel 204 are measured (step S72). Thereupon, when the supply pump 208 has been driven for a prescribed period of time in the forward direction (step S74), the liquid pressures (the pressures after liquid conveyance in the forward direction) R6, S6 in the supply flow channel 202 and the recovery flow channel 204 are measured (step S76). Subsequently to this, when the recovery pump 210 has been driven for a prescribed period of time in the reverse direction (step S78), the liquid pressures (the pressures after liquid conveyance in the reverse direction) R7, S7 in the supply flow channel 202 and the recovery flow channel 204 are measured (step S80). After waiting until a prescribed time period has elapsed (step S82), the liquid pressures (the pressures after standby) R8 and S8 in the supply flow channel 202 and the recovery flow channel 204 are measured. These liquid pressures R5 to R8 and S5 to S8 are measured by the corresponding pressure sensors 216A and 216B.

Next, abnormality judgment and abnormal location identification for the ink supply system is carried out on the basis of the liquid pressures R1 to R8 measured by the first pressure sensor 216A and the liquid pressures S1 to S8 measured by the second pressure sensor 216B, using the abnormal location identification judgment table shown FIG. 11 (step S86).

More specifically, as shown in FIG. 11, abnormality judgment and abnormal location identification are carried out on the basis of whether or not the following conditions N1 to N12 are satisfied. In FIG. 11, a case where each condition is established is indicated with the term of "SATISFIED" symbol, and a case where it is not established is indicated with the term of "UNSATISFIED".

| | |
|---|---|
| $R2>R1$ | Condition N1 |
| $S2>S1$ | Condition N2 |
| $R3>R2$ | Condition N3 |
| $S3>S2$ | Condition N4 |
| $R3\approx R4$ | Condition N5 |
| $S3\approx S4$ | Condition N6 |
| $R6>R5$ | Condition N7 |
| $S5\approx S6$ | Condition N8 |
| $S7>S6$ | Condition N9 |
| $R6\approx R7$ | Condition N10 |
| $R7\approx R8$ | Condition N11 |
| $S7\approx S8$ | Condition N12 |

In the condition formulas N5, N6, N8, N10, N11 and N12, the range where it is considered that the liquid pressure on the left-hand side and the liquid pressure on the right-hand side are substantially equal is the variation tolerance range of the liquid pressure when no ink leaks have occurred in the supply flow channel 202 or the recovery flow channel 204. In the present embodiment, the liquid pressures are taken to be substantially the same provided that the liquid pressure on the right-hand side is in the range of 90% to 110% (and desirably 95% to 105%) of the liquid pressure on the left-hand side.

Here, the correspondence between the establishment of the conditions N1 to N12 and the abnormal location will be described.

Firstly, if all of the conditions N1 to N12 are established (i.e. the case of PT1 in FIG. 11), then the change in the liquid pressure in the supply flow channel 202 and the recovery flow channel 204 due to the driving of the supply pump 208 and the recovery pump 210 is appropriate, and it is judged that the ink supply system is operating normally.

On the other hand, a case where the conditions N1 and N3 are not established (i.e. the case of PT2 in FIG. 11) arises either when pressure measurement by the first pressure sensor 216A is not possible or when the liquid pressure measured by the first pressure sensor 216A is indicating an abnormal value, and hence the first pressure sensor 216A is identified as the location of an abnormality. In this case, the condition N7 is not established either, and therefore this condition can also be added as a judgment condition for identifying an abnormal location.

Furthermore, a case where the conditions N2 and N4 are not established (i.e. the case of PT3 in FIG. 11) arises either when pressure measurement by the second pressure sensor 216B is not possible or when the liquid pressure measured by the second pressure sensor 216B is indicating an abnormal value, and hence the second pressure sensor 216B is identified as the location of an abnormality. In this case, the condition N9 is not established either, and therefore this condition can also be added as a judgment condition for identifying an abnormal location.

Moreover, a case where the conditions N2 and N3 are not established (i.e. the case of PT4 in FIG. 11) and a case where the conditions N8 and N10 are not established (i.e. the case of PT5 in FIG. 11) arise when the open/closed state of the bypass valve 220 is reversed, and hence the bypass valve 220 is identified as the location of an abnormality.

Furthermore, cases where the conditions N5 and N6 are not established (i.e. the cases of PT6 and PT7 in FIG. 11) arise when there is an ink leak in the supply flow channel 202 or the recovery flow channel 204. In cases such as this, by identifying whether or not the conditions N11 and N12 are established, it is possible to identify which of the supply flow channel 202 and the recovery flow channel 204 has produced the ink leak. More specifically, if the condition N11 is not established, then the supply flow channel 202 is the location of the abnormality, and if the condition N12 is not established, then the recovery flow channel 204 is the location of the abnormality.

Furthermore, a case where the conditions N1 and N2 are not established (i.e. the case of PT8 in FIG. 11) arises when there is a failure in the supply pump 208 or when there is a blockage in the supply flow channel 202, and hence the supply pump 208 or the supply flow channel 202 is identified as the location of an abnormality. In this case, the condition N7 is not established either, and therefore this condition can also be added as a judgment condition for identifying an abnormal location.

Furthermore, a case where the conditions N3 and N4 are not established (i.e. the case of PT9 in FIG. 11) arises when there is a failure in the recovery pump 210 or when there is a blockage in the recording flow channel 204, and hence the recovery pump 210 or the recovery flow channel 204 is identified as the location of the abnormality. In this case, the condition N9 is not established either, and therefore this condition can also be added as a judgment condition for identifying an abnormal location.

After abnormality judgment processing has been carried out in this way, it is judged whether or not there is an abnormality in the ink supply system on the basis of these judgment results (step S88). If there is no abnormality, the procedure then advances to step S90, whereas if there is an abnormality, then the procedure advances to step S96.

If it is judged at the next step S26 that there is no abnormality in the ink supply system, then the main operation of the ink supply system is started (step S90). In this case, the system controller 72 opens the head valve 218, and controls the driving of the supply pump 208 and the recovery pump 210 in such a manner that the liquid pressures measured by the first and second pressure sensors 216A and 216B respectively approach the prescribed reference pressure (target pressure) so as to controls the pressure in the supply flow channel 202 and the recovery flow channel 204. By this means, the ink supplied from the ink tank 200 is circulated at all times through the ink flow channels inside the head modules 152 (and in particular in the vicinity of the nozzles), regardless of whether or not an ink ejection operation is performed, and therefore ejection defects caused by increased viscosity of the ink, and the like, can be prevented and good printing quality can be maintained over a long period of time.

Subsequently, it is judged whether or not printing has ended (step S92). If printing has not ended, the judgment in step S92 is repeated until printing has ended. If printing has ended, then an ink supply system halting process is carried out (step S94).

On the other hand, if it is judged in the preceding step S88 that there is an abnormality in the ink supply system, then an abnormal location report is issued (step S96). The mode of reporting the abnormal location is similar to that of the first embodiment. After the abnormal location report has been issued, an ink supply system halting process is carried out (step S94).

According to the second embodiment which is described above, in an ink supply system which performs ink circulation between an ink tank 200 and a plurality of head modules 152, a pressure change is applied to the supply flow channel 202 and the recovery flow channel 204 in accordance with driving of the supply pump 208 and the recovery pump 210 before starting main operation, and the pressure in the supply flow channel 202 and the recovery flow channel 204 before and after the pressure change is measured by the first and second pressure sensors 216A and 216B. By comparing the direction in which the pressure change is applied by the supply pump 208 and the recovery pump 210 with the direction of the change of the measurement values of the first and second pressure sensors 216A and 216B, it is possible to judge the presence or absence of an abnormality in the ink supply system, as well as identifying the abnormal location. By this means, if there is an abnormality in the ink supply system, then it is possible to restore the system rapidly, and hence stable and highly reliable ink supply can be achieved. Furthermore, it is also possible to ensure stable printing in the inkjet recording apparatus 10.

Furthermore, in an ink supply system relating to the second embodiment, pressure control is implemented in such a manner that the liquid pressure in the supply flow channel 202 is relatively higher than the liquid pressure in the recovery flow channel 204, while a prescribed back pressure (negative pressure) is applied to the ink inside the head modules 152. By this means, the ink supplied from the ink tank 200 is circulated at all times through the ink flow channels inside the head modules 152 (and in particular in the vicinity of the nozzles), regardless of whether or not an ink ejection operation is performed, and therefore ejection defects caused by increased viscosity of the ink, and the like, can be prevented and good printing quality can be maintained over a long period of time.

In each of the embodiments described above, the measurement values obtained by two pressure sensors are used in order to judge abnormalities in an ink supply system and to identify the location of an abnormality, but the present invention is not limited to this and it is of course also possible to use the measurement values obtained by three or more pressure sensors. For example, if the measurement values obtained by three pressure sensors are used, then it is possible to identify the location of an abnormality even if two pressure sensors break down at the same time.

Abnormality judgment apparatuses and abnormality judgment methods for a liquid supply system according to embodiments of the present invention have been described in detail above, but the present invention is not limited to the aforementioned examples, and it is of course possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An abnormality judgment apparatus of a liquid supply system which supplies liquid from a liquid tank to a liquid ejection head via a liquid flow channel, the abnormality judgment apparatus comprising:

a pressure change application device which applies a pressure change to the liquid flow channel;

first and second pressure measurement devices which measure a pressure in the liquid flow channel; and an abnormality judgment device which performs abnormality judgment and identification of an abnormal location in the liquid supply system, according to measurement values measured by the first and second pressure measurement devices before and after the pressure change is applied by the pressure change application device, wherein if the measurement value obtained by one of the first and second pressure measurement devices changes in a direction which is same as a direction in which the pressure change is applied by the pressure change application device, and the measurement value obtained by the other of the first and second pressure measurement devices changes in a direction opposite to the direction in which the pressure change is applied by the pressure change application device or does not change, then the abnormality judgment device identifies the other of the first and second pressure measurement devices as the abnormal location.

2. The abnormality judgment apparatus of a liquid supply system as defined in claim 1, wherein the pressure change application device is a liquid pump disposed in the liquid flow channel.

3. The abnormality judgment apparatus of a liquid supply system as defined in claim 1, wherein the abnormality judgment device performs the abnormality judgment and the identification of an abnormal location before main operation of the liquid supply system is started.

4. The abnormality judgment apparatus of a liquid supply system as defined in claim 1, wherein the liquid ejection head is a line head constituted by a plurality of head modules; and the plurality of head modules are connected to the first and second liquid flow channels via first and second branch channels which are provided for each of the plurality of head modules.

5. An abnormality judgment apparatus of a liquid supply system which supplies liquid from a liquid tank to a liquid ejection head via a liquid flow channel, the abnormality judgment apparatus comprising:

a pressure change application device which applies a pressure change to the liquid flow channel;

first and second pressure measurement devices which measure a pressure in the liquid flow channel; and an abnormality judgment device which performs abnormality judgment and identification of an abnormal location in the liquid supply system, according to measurement values measured by the first and second pressure measurement devices before and after the pressure change is applied by the pressure change application device, wherein if the measurement values obtained by the first and second pressure measurement devices both change in a direction opposite to a direction in which the pressure change is applied by the pressure change application device or do not change, then the abnormality judgment device identifies the pressure change application device or the liquid flow channel as the abnormal location.

6. An abnormality judgment apparatus of a liquid supply system which supplies liquid from a liquid tank to a liquid ejection head via a liquid flow channel, the abnormality judgment apparatus comprising:

a pressure change application device which applies a pressure change to the liquid flow channel;

first and second pressure measurement devices which measure a pressure in the liquid flow channel; and an abnormality judgment device which performs abnormality judgment and identification of an abnormal location in the liquid supply system, according to measurement values measured by the first and second pressure measurement devices before and after the pressure change is applied by the pressure change application device, wherein if the measurement values obtained by the first and second pressure measurement devices both change beyond a prescribed range in a state where the pressure change is not applied by the pressure change application device, the abnormality judgment device identifies the liquid flow channel as the abnormal location.

7. An abnormality judgment apparatus of a liquid supply system which supplies liquid from a liquid tank to a liquid ejection head via a first liquid flow channel and recovers liquid from the liquid ejection head to the liquid tank via a second liquid flow channel, the abnormality judgment apparatus comprising:

a pressure change application device which applies a pressure change to each of the first and second liquid flow channels;

a first pressure measurement device which measures a pressure in the first liquid flow channel;

a second pressure measurement device which measures a pressure in the second liquid flow channel;

an abnormality judgment device which performs abnormality judgment and identification of an abnormal location in the liquid supply system, according to measurement values measured by the first and second pressure measurement devices before and after the pressure change is applied by the pressure change application device;

a bypass flow channel which directly connects the first liquid flow channel with the second liquid flow channel without passing through the liquid ejection head; and a flow channel opening and closing device configured so as to be capable of opening and closing the bypass flow channel, wherein the abnormality judgment device performs the abnormality judgment and the identification of an abnormal location in the liquid supply system, according to measurement values obtained by the first and second pressure measurement devices when the bypass flow channel is closed by the flow channel opening and closing device, and measurement values obtained by the first and second pressure measurement devices when the bypass flow channel is opened by the flow channel opening and closing device.

8. The abnormality judgment apparatus of a liquid supply system as defined in claim 7, wherein the liquid ejection head is a line head constituted by a plurality of head modules; and the plurality of head modules are connected to the first and second liquid flow channels via first and second branch channels which are provided for each of the plurality of head modules.

9. An abnormality judgment method of a liquid supply system including a pressure change application device which applies a pressure change to a liquid flow channel via which liquid is supplied from a liquid tank to a liquid ejection head; and first and second pressure measurement devices which measure a pressure in the liquid flow channel, the abnormality judgment method comprising the step of performing abnormality judgment and identification of an abnormal location in the liquid supply system according to measurement values measured by the first and second pressure measurement devices before and after the pressure change is applied by the pressure change application device, wherein if the measurement value obtained by one of the first and second pressure measurement devices changes in a direction which is same as a direction in which the pressure change is applied by the pressure change application device, and the measurement value obtained by the other of the first and second pressure measurement devices changes in a direction opposite to the direction in which the pressure change is applied by the pressure change application device or does not change, then the other of the first and second pressure measurement devices is identified as the abnormal location.

10. An abnormality judgment method of a liquid supply system including a pressure change application device which applies a pressure change to a liquid flow channel via which liquid is supplied from a liquid tank to a liquid ejection head; and first and second pressure measurement devices which measure a pressure in the liquid flow channel, the abnormality judgment method comprising the step of performing abnormality judgment and identification of an abnormal location in the liquid supply system according to measurement values measured by the first and second pressure measurement devices before and after the pressure change is applied by the pressure change application device, wherein if the measurement values obtained by the first and second pressure measurement devices both change in a direction opposite to a direction in which the pressure change is applied by the pressure change application device or do not change, then the pressure change application device or the liquid flow channel is identified as the abnormal location.

11. An abnormality judgment method of a liquid supply system including a pressure change application device which applies a pressure change to a liquid flow channel via which liquid is supplied from a liquid tank to a liquid ejection head; and first and second pressure measurement devices which measure a pressure in the liquid flow channel, the abnormality judgment method comprising the step of performing abnormality judgment and identification of an abnormal location in the liquid supply system according to measurement values measured by the first and second pressure measurement devices before and after the pressure change is applied by the pressure change application device, wherein if the measurement values obtained by the first and second pressure measurement devices both change beyond a prescribed range in a state where the pressure change is not applied by the pressure change application device, the liquid flow channel is identified as the abnormal location.

* * * * *